United States Patent [19]

Beck et al.

[11] Patent Number: 4,641,729

[45] Date of Patent: Feb. 10, 1987

[54] METHOD AND APPARATUS FOR STABILIZING A LADDER

[76] Inventors: Andrew C. Beck; Shirley E. Beck, both of 2204 Tall Oaks Trail, Edmond, Okla. 73034

[21] Appl. No.: 793,661

[22] Filed: Oct. 31, 1985

[51] Int. Cl.[4] ..... E06C 1/22; E06C 5/36

[52] U.S. Cl. ..... 182/172

[58] Field of Search ..... 182/172, 170, 165, 168; 248/412

[56] References Cited

U.S. PATENT DOCUMENTS

| | | | |
|---|---|---|---|
| 281,977 | 7/1883 | Coons | 182/170 |
| 1,610,596 | 12/1926 | Bird | 182/172 |
| 1,970,624 | 8/1934 | Recker | 248/412 |
| 2,997,127 | 8/1961 | Wojtowicz | 182/172 |
| 3,508,628 | 4/1970 | Conrad | 182/172 |
| 3,786,900 | 1/1974 | Olsen | 182/172 |
| 3,856,112 | 12/1974 | Stewart | 182/172 |
| 3,878,917 | 4/1975 | McBride | 182/172 |
| 3,901,354 | 8/1975 | Grebausky | 182/172 |
| 4,565,262 | 1/1986 | Hawkins | 182/172 |

*Primary Examiner*—Reinaldo P. Machado
*Attorney, Agent, or Firm*—Merchant, Gould, Smith, Edell, Welter & Schmidt

[57] ABSTRACT

A ladder stabilizer (32, 232) suitable for use with a ladder (30, 230). A preferred stabilizer (32) includes an elongate telescoping stabilizer member (46) which is pivotally connected to the apex of the ladder (30). The inner submember (50) is pivotally attached to the apex of ladder (30). The outer submember (52) of the stabilizer (46) is operatively connected to pivotally opposing uprights (34) and (36) such that the stabilizer (32) enjoys a three point connection to the ladder (30) to maximize the rigidity of the ladder/ladder stabilizer combination. Preferred embodiments include lock assemblies (62, 81, 82). Release of the lock assemblies allows the stabilizer to be laterally and transversely adjusted. When the lock assemblies are activated, the stabilizer (46) is locked relative to the ladder (30) thereby stabilizing the ladder regardless of the ground conditions or the presence of a wall, for example.

16 Claims, 23 Drawing Figures

METHOD AND APPARATUS FOR STABILIZING A LADDER

FIELD OF THE INVENTION

This invention relates generally to ladders and, more particularly, to methods and apparatus for stabilizing ladders.

BACKGROUND OF THE INVENTION

Ladders are well-known and useful implements. There are various types of ladders, including step ladders and extension ladders. While ladders are generally useful and convenient, they do suffer the disadvantage of being somewhat unstable, tending to tip laterally if a lateral force is applied thereto, particularly when the force is applied above the center of gravity of the ladder. As used herein, the term "lateral" refers to a direction or motion which is substantially parallel to the rungs or steps of a ladder. For example, a lateral adjustment would be one which is substantially parallel to the rungs or steps of the ladder. Also, ladders can possess a lack of transverse stability under certain circumstances. The term "transverse" herein refers to a direction which is substantially perpendicular to the rungs or steps of a ladder.

The present invention is directed to a method and apparatus for stabilizing a ladder, to minimize the unstableness which is characteristic of most commercial and non-commercial ladders.

Preferably, a ladder stabilizer will accommodate an uneven ground surface and will also allow an individual using a ladder to lean in various directions and move about without causing the ladder to sway or slip. It is also preferable that a ladder stabilizer be fully adjustable to accommodate other conditions such as the presence of a wall, tree, etc., while still rigidly and safely bracing the ladder.

Prior art ladder stabilizers generally do not provide sufficient adjustability and stability. For example U.S. Pat. No. 3,856,112, issued to A. H. Stewart, discloses a ladder stabilizer which basically includes a pair of slidably-connected elongate members, the uppermost of which is pivotally connected to the apex of a standard step ladder. While the stabilizer is apparently quite adjustable to accommodate various ground conditions, it is connected to the ladder at only one point. Such a "one point" connection technique generally does not provide a sufficiently rigid connection between the ladder and the stabilizer to securely brace the ladder against transverse and lateral disturbances. Thus, for example, if such a stabilizer was utilized and the ladder supplied with same was subjected to a transverse force the stabilizer would naturally tend to slide or or buckle since it is only connected to the ladder by a simple universal joint connection or the like near the platform of the step ladder. U.S. Pat. No. 3,901,354, issued to A. J. Grebausky, discloses another step ladder stabilizer which includes an extensible leg which is pivotally attached to a platform of a ladder. Once again, however, the spindly stabilizer element is only attached to the step ladder at one point so its strength and rigidity naturally suffer.

U.S. Pat. No. 3,878,917, issued to L. R. McBride, shows a similar stabilizer element for use with a "leanto" ladder as opposed to a step ladder. The McBride stabilizer, like the stabilizer discussed above, simply includes means for attaching the extensible stabilizer element to the apex of a ladder.

By contrast, the stabilizer disclosed in U.S. Pat. No. 3,508,628, issued to C. J. Conrad, includes a stabilizer element which is attached to the side rail or upright of a ladder at two points. This attachment scheme offers greater lateral strength and stability, but renders the stabilizer less adjustable. That is, the distance between the lower tip of the extensible stabilizer element and the ladder upright cannot be readily laterally adjusted depending on the ground conditions or the proximity of a wall or other impedient. Also, although the extensible stabilizer element of the Conrad stabilizer is attached at two points to the upright of a ladder, it is attached to only one of the ladder's uprights. Therefore, the stabilizer of conrad is not well braced against transverse loads or impacts; it will tend to move relative to the ladder uprights when subjected to a transverse load. Further, the Conrad stabilizer is not laterally adjustable, having only fully collapsed and fully extended lateral positions or states.

U.S. Pat. No. 3,786,900, issued to P. J. Olsen, discloses still another ladder stabilizer which is pivotally attached at its upper tip to the platform of a step ladder. The stabilizer element is also connected at its midpoint to the ladder. The element which attaches the midpoint of the stabilizer element to the ladder is transversely stabilized by a pair of elements which are attached to opposing side rails or uprights on the step ladder. This scheme provides some transverse and lateral strength and stability to the stabilizer element. However, the Olsen stabilizer is not laterally adjustable in a manner which allows it to accommodate various ground conditions. In addition, it is not transversely adjustable. A preferred stabilizer would possess lateral and transverse adjustability to accommodate a wide variety of ground conditions, while at the same time adequately bracing the ladder so that it will safely support an individual whose task necessitates moving about on the ladder and leaning to one side of the ladder or the other.

The ladder stabilizer of the present invention is directed to the shortcomings of prior art ladder stabilizers. In particular, it provides a laterally adjustable stabilizer which is sufficiently braced to provide sufficient lateral and transverse strength and stability to the ladder. A preferred embodiment includes an elongate stabilizer element which is also transversely adjustable. Lateral and transverse adjustment makes the ladder stabilizer useful irrespective of the environment in which the ladder must be used.

SUMMARY OF THE INVENTION

In its broadest form, the present invention includes a ladder stabilizer for a ladder having first and second uprights suitable for resting on a ground surface, including:

(a) a stabilizer member having a top portion and a bottom portion, wherein the bottom portion is suitable for engaging the ground surface;

(b) means for pivotally connecting the top portion of the stabilizer member to the ladder;

(c) first adjusting means for operatively connecting the stabilizer member to the first upright; and (d) second adjusting means for operatively connecting the stabilizer member to the second upright, wherein the stabilizer member can be laterally adjusted to vary the distance between the bottom portion of the stabilizer member and the ladder.

In a preferred embodiment, the first and second adjusting means each include an adjusting element pivotally connected to the associated upright and means for slidably connecting the element to the stabilizer member.

In another preferred embodiment, the central portion of the stabilizer member is connected to the uprights through the use of the adjusting means.

Another preferred embodiment of the ladder stabilizer of the present invention includes a pair of adjusting element lock assemblies operatively connected to the central portion of the stabilizer member. Each lock assembly preferably includes a lock housing, a stationary gripping means, a movable gripping means, and means for urging the movable gripping means toward the stationary gripping means. The associated adjusting elements slide through the lock housings and the gripping means and when it is desirable to laterally lock the stabilizer member the urging means are activated to cause the gripping means to grip the associated adjusting elements. When it is desirable to laterally adjust the stabilizer member, the urging means are released so that the adjusting elements can freely slide through their associated lock housings.

The gripping means are preferably hardened screws and the urging means are preferably set screws arranged substantially perpendicular to the associated movable hardened screws.

The stabilizer member which is pivotally connected to the ladder preferably includes first and second telescoping stabilizer submembers. Also, there is preferably a stabilizer lock assembly operatively connected to the telescoping submembers. This lock assembly is preferably substantially similar to the lock assembly for the adjusting elements. That is, it is preferably made up of a lock housing and stationary and movable hardened screws and a set screw. When it is desirable to lock the slidable submembers so that the stabilizer member cannot be lengthened or shortened, the set screw is tightened so as to force the movable hardened gripping screw toward the stationary hardened gripping screws. Also, when it is desirable to release the lock assembly so as to allow for length adjustment of the stabilizer member, the set screw is loosened.

The joint between the ladder and the stabilizer member is preferably a universal joint such that the stabilizer member can be laterally and tranvsersely adjusted depending on the conditions which exist in the area of the ladder.

Further, the ladder stabilizer of the present invention is preferably usable with various types of ladders, including step ladders and extension ladders. When the ladder is a step ladder, the adjusting elements preferably interconnect the central porton of the stabilizer member and pivotally opposing uprights. When the ladder is an extension ladder, the adjusting elements preferably interconnect the central portion of the ladder stabilizer and opposing uprights of the lower section of the extension ladder. In either case, a ladder stabilizer is attached to the ladder at three points, providing for a particularly rigid and safe system.

Of course, a preferred ladder according to the present invention includes a pair of ladder stabilizers on opposite sides of the ladder so as to prevent the ladder from tipping over in either side direction.

Lastly, the present invention includes a method for stabilizing a ladder, including the steps of:

(a) selecting a stabilizer member having a top portion and a bottom portion, wherein the bottom portion is suitable for engaging the ground surface;

(b) pivotally connecting the top portion of the stabilizer member to the ladder;

(c) adjustably connecting the stabilizer to the first upright; and (d) adjustably connecting the stabilizer to the second upright wherein the stabilizer member can be laterally adjusted to vary the distance between the bottom portion of the stabilizer member and the ladder.

DETAILED DESCRIPTION OF PREFERRED EMBODIMENTS OF THE INVENTION

Figure 2:
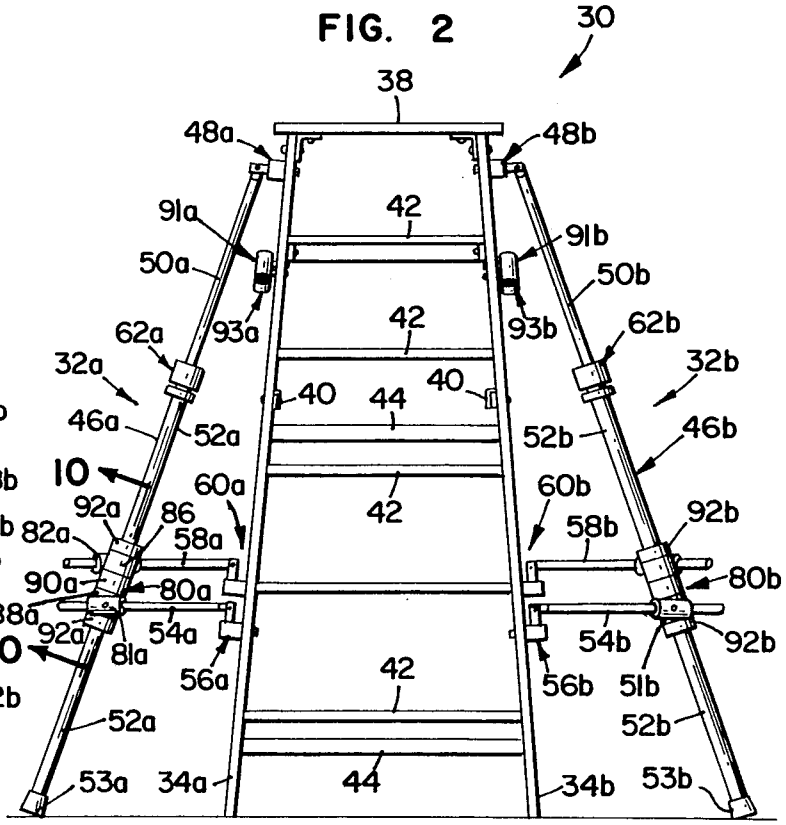
FIG. 2 is a front elevational view of the ladder and stabilizer of FIG. 1.
Figure 1:
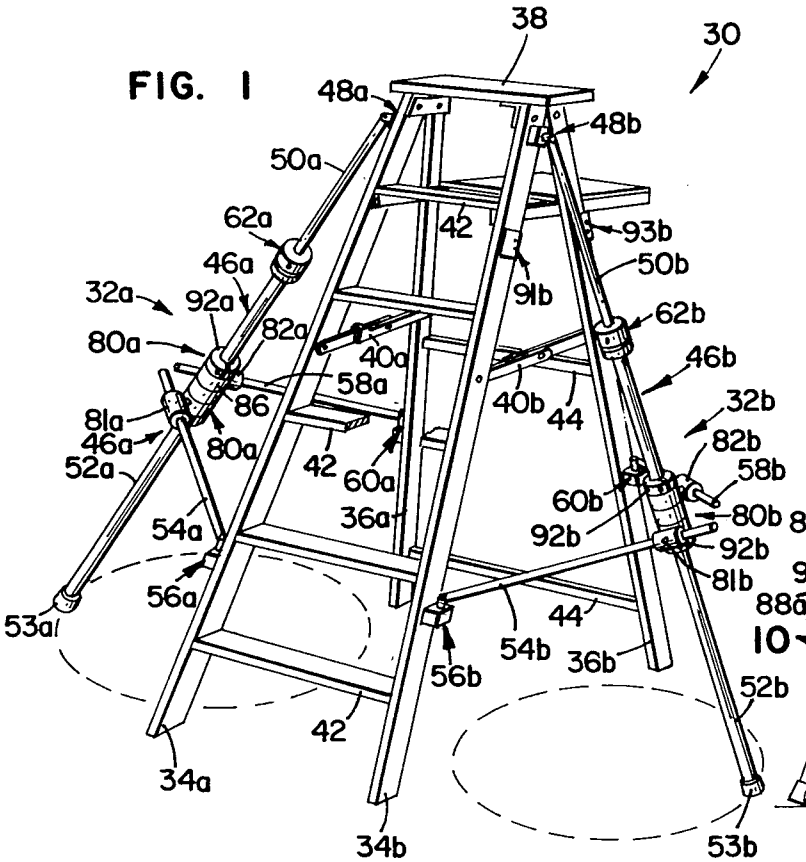
FIG. 1 is a perspective view of an extended step ladder provided with a ladder stabilizer of the present invention.

Referring to the Drawing, wherein like reference numerals represent like parts and assemblies throughout the several views, FIG. 1 shows a perspective view of a step ladder 30 including a pair of ladder stabilizers 32 of the present invention. Step ladder 30 is illustrated and described only by way of example, and the ladder stabilizers 32 can work with any conventional or commercial step ladder.

The step ladder 30 includes a pair of main uprights 34 and a pair of back uprights 36, with the uprights 34 and 36 being pivotally connected at the apex of the ladder to a platform 38. A pair of stop braces 40 are pivotally connected to opposing pairs of uprights 34 and 36 roughly at their midpoints and span the distance therebetween. As is well known, the stop braces 40 includes means for limiting the angular displacmeent between the uprights 34 and 36. FIG. 1 shows the step ladder 30 in its fully extended state.

The main uprights 34 of the step ladder 30 are intermittently spanned by steps 42 according to normal step ladder construction. Further, the back uprights 36 are intermittently spanned by back cross pieces 44.

As shown in FIGS. 1-4, the ladder stabilizers 32 each preferably include an elongate tubular stabilizer rod assembly 46 which is pivotally connected to the associated main upright 34 toward the apex of the ladder. The stabilizer rod assemblies 46 are attached to respective main uprights 34 by means of a pair of upper pivoting head assemblies 48, further described below.

Each stabilizer rod assembly 46 includes an inner tube 50 which is pivotally connected to the associated pivoting head assembly 48. The stabilizer rod assemblies 46 also each include an outer tube 52 which telescopically receives the associated inner tube 50. The outer tubes 52 are located on the lower portions of the stabilizer rod assemblies 46, and terminate at their lower ends with rubber cups 53 or the like suitable for frictionally engaging the ground surface. Thus the stabilizer rod assemblies 46 are attached at their uppermost points to the apex of the step ladder 30.

It should be noted that the tubes 50 and 52 are preferably aluminum tubing or the like and are machined using standard techniques.

In addition to their connections at the apex of the ladder 30, the stabilizer rod assemblies 46 are supported at two other points. A pair of front diagonal adjusting rods 54 are pivotally connected to associated outer tubes 52 and pivotally connected to associated lower front pivoting head assemblies 56. The lower front pivoting head assemblies 54 are attached to associated main uprights 34.

The outer tubes 52 of the stabilizer rod assemblies 46 are similarly connected to the back uprights 36 by means of a pair of rear diagonal adjusting rods 58 which are pivotally connected to the outer tubes 52 and pivotally connected to the back uprights 36. The connections between the rear diagonal adjusting rods 58 and the back uprights 36 are preferably made by a pair of lower rear pivoting head asesmblies 60 which are preferably mechanically identical to the lower front pivoting head assemblies 56. As show in FIG. 2, however, the lower rear pivoting head assemblies 60 are mounted slightly higher on the back uprights 36 than are the front assemblies 56 on the main uprights 34. The reason for this will become evident as the ladder stabilizers 32 are further described below.

As noted above, the inner tubes 50 are slidably received by the outer tubes 52. This allows the stabilizer rod assemblies 46 to be extended or contracted to conform to the particular ground conditions. In order to lock associated tubes 50 and 52 together once the adjustment process is completed, the outer tubes 52 include at their upper ends stabilizer rod locks 62.

Figure 7:
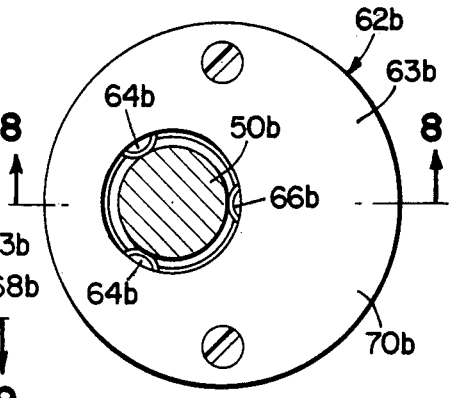
FIG. 7 is a top plan view of a stabilizer rod lock of the ladder stabilizer of FIG. 4 as viewed along line 7—7.

FIG. 7 shows a top view of one of the stabilizer rod locks 62. As shown in FIG. 7, the stabilizer rod locks 62 form eccentric openings suitable for receiving the inner tubes 50. Each rod lock 62 contains two stationary hardened screws 64 and a movable hardened screw 66. The stationary screws 64 and the movable screw 66 are preferably spaced about the associated inner tube 50 at 120° intervals and are aligned so that their longitudinal axes are parallel with the centerline of the tubes 50 and 52. The inner tubes 50 are in contact only with the associated screws 64 and 66.

Figure 8:
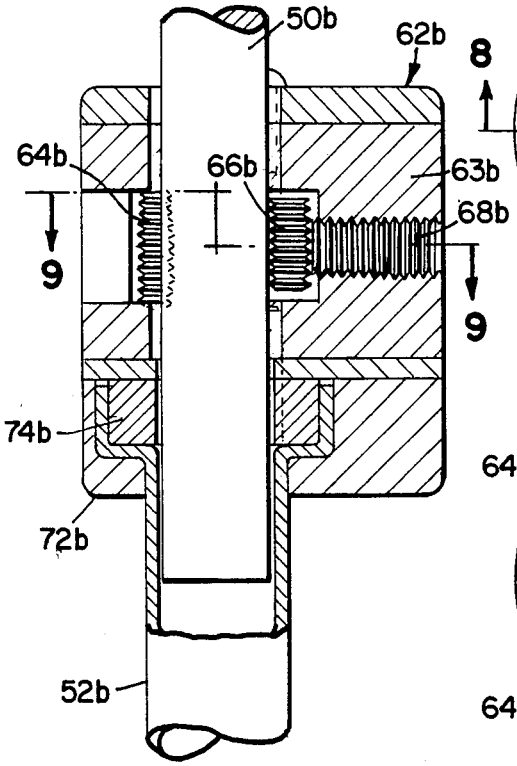
FIG. 8 is a cross-sectional view of the stabilizer rod lock of FIG. 7, taken generally along line 8—8.
Figure 9:
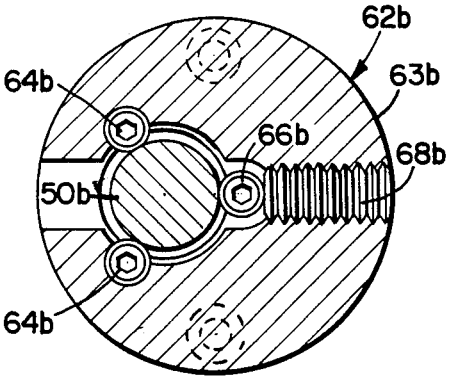
FIG. 9 is a cross-sectional view of the stabilizer rod lock of FIG. 8, taken generally along line 9—9.

In contact with each movable screw 66 and preferably perpendicular thereto is a set screw 68, best shown in FIG. 8. The housings 63 are internally threaded to accept the set screws 68. When one of the set screws is appropriately turned, it engages the corresponding movable screw 66 and applies pressure to it so that it in turn presses against the corresponding inner tube 50. This causes the threads on the screws 64 and 66 to grip the corresponding inner tube 50.

The rod lock housings 63 are connected to base plates 72 using conventional fasteners (see FIG. 8). The base plates 72 are machined or formed to receive flanged upper ends of the outer tubes 52. Container rings 74 fit on the inside of the flanged upper ends of the outer tubes 52 so that the flanged ends are held between the container rings 74 and the corresponding base plates 72 when the base plates 72 are connected to the rod lock housings 63. Thus the inner tubes 50 are locked to outer tubes 52 when the set screws 68 are appropriately rotated to apply pressure to the movable screws 66.

It should be noted that it is possible to use a greater number of stationary screws 64 in order to better distribute the load and create more uniform pressure about the inner tubes 50. For example, see FIG. 11, a sectional view of a diagonal rod lock.

Referring again to FIG. 1, the outer tubes 52 support ring assemblies 80, preferably near the midpoints of the outer tubes 52. Each ring assembly 80 is made up of five "rings" which encircle the corresponding outer tube 52. First and fifth rings 92 are locked on the outer tubes 52, whereas second third and fourth rings, 86, 90 and 88, respectively, are free to rotate about the outer tubes 52.

Figure 10:
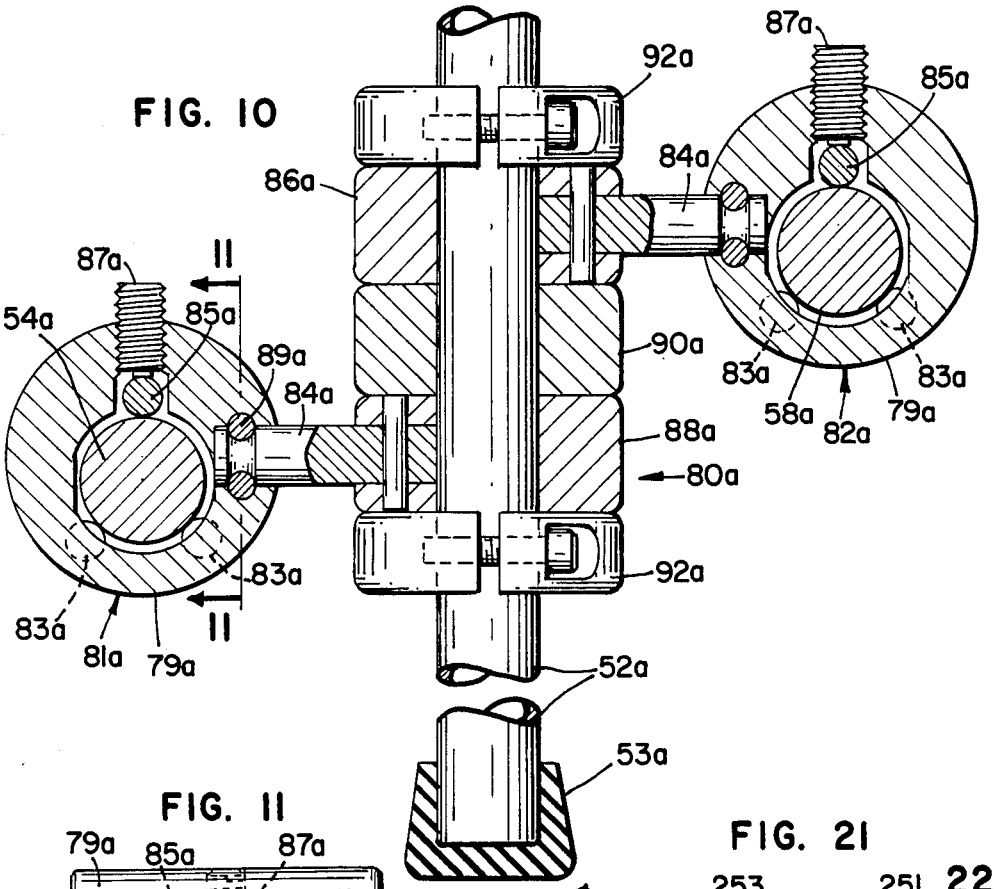
FIG. 10 is a cross-sectional view of the ring assembly of the ladder stabilizer of FIG. 2, taken generally along line 10—10.

Referring to FIG. 10, the second and fourth rings, 86 and 88, respectively, support diagonal rod lock assemblies 81 and 82 which are preferably substantially similar to the stabilizer rod locks 62, described above. The diagonal rod lock assemblies 81 and 82, however, respectively receive the diagonal adjusting rods 54 and 58.

Figure 11:
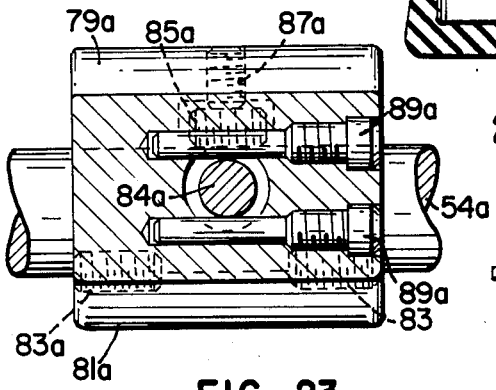
FIG. 11 is a cross-sectional view of a diagonal rod lock of the stabilizer of FIG. 10, taken generally along line 11—11.

As shown in FIG. 11, the diagonal rod lock assemblies 81 and 82 include stationary screws 83, movable screws 85 and set screws 87 in a manner very similar to the stabilizer rod locks 62. The screws 83, 85 and 87 are received by an appropriately machined housing 79. It should be noted that the diagonal rod locks 81 and 82 include four stationary screws 83, but otherwise they are substantially mechanically identical to the stabilizer rod locks 62.

The diagonal rod lock assemblies 81 and 82 are pivotally connected to stub shafts 84 which extend from the second and fourth rings 86 and 88 of the ring assemblies 80. As shown in FIG. 10, pins 89 slidably constrain a circumferential groove in stub shafts 84.

As noted above, the second and fourth rings 86 and 88 of ring assemblies 80 are sized so as to freely rotate upon the associated outer tube 52. Thus, when the movable screws 85 of the diagonal rod locks 81 and 82 are loosened, the diagonal rods 54 and 58 can freely move through the housing 79 of the diagonal rod lock assemblies 81 and 82 while the rings 86 and 88 can freely rotate about the outer tube 52.

Referring again to FIG. 10, between the second and fourth rings 86 an 88 is the third ring 90 which also freely rotates about the outer tube 52 and simply acts as a spacer between the rings 86 and 88. Completing the ring assembly 80 are the lock rings 92 which are clamped about and grip the outer tubes 52 so as to axially anchor the entire ring assemblies 80 on the outer tubes 52. Appropriate clearances are maintained between the rings so as to allow the free rotation of the second, third and fourth rings 86, 90 and 88.

The operation of the diagonal rod locks 81 and 82 can now be briefly described: Once the stabilizer rod assemblies 46 have been sufficiently pivoted away from the step ladder 30, the diagonal rod lock assemblies 81 and 82 can be locked by appropriately turning their associated set screws 87 so that their movable hardened screws 85 will engage the diagonal adjusting rods 54 and 58 to cause the screws 83 and 85 to "bite" into the diagonal adjusting rods 54 and 58, thereby locking the diagonal adjusting rods 54 and 58 to the diagonal rod lock assemblies 81 and 82, respectively, to prevent linear relative motion therebetween. Thus the stabilizer rod assemblies 46 are locked and cannot pivot relative to the step ladder 30.

Figure 3:
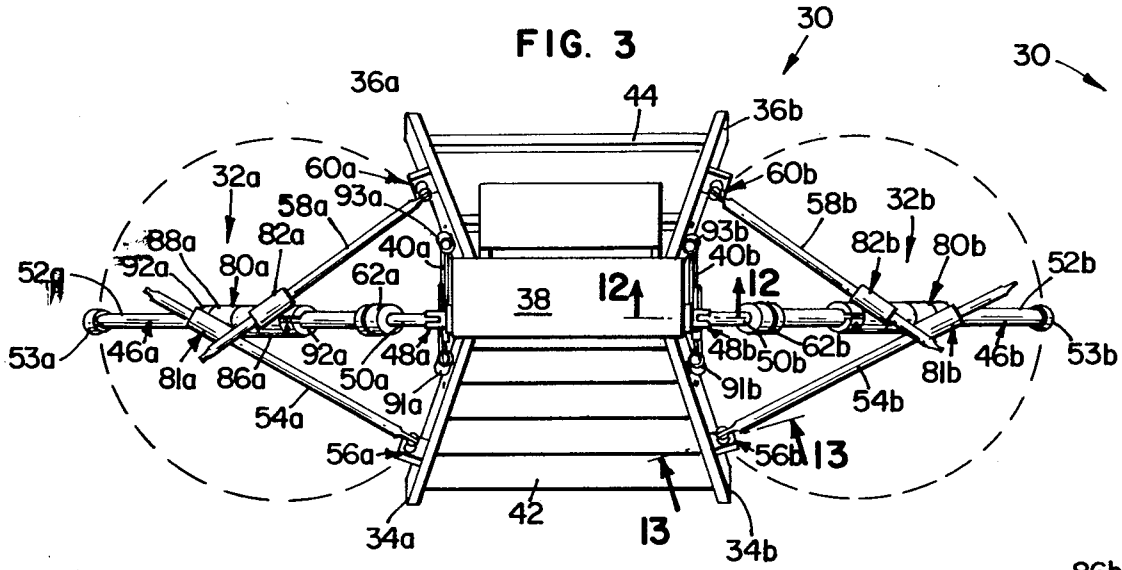
FIG. 3 is a top plan view of the ladder and stabilizer of FIG. 1.

As noted above, the stabilizer rod assemblies 46 are preferably pivotally connected at their upper tips to the apex of step ladder 30. Actually, it is preferably that the joints between the stabilizer rod assemblies 46 and the step ladder 30 be in the nature of universal joints so that the stabilizer rod assemblies 46 can be easily adjusted both laterally and transversly. This is illustrated in FIGS. 1 and 3 by the pair of dashed circles adjacent the base of step ladder 30. Preferably the stabilizer rod assemblies 46 can be adjusted so that they can easily be positioned anywhere within the dashed circle. Of course, other embodiments of the ladder stabilizer 32 could allow for even a wider range of adjustment, and the dashed circles of FIGS. 1 and 3 are only shown by way of example; the present invention is certainly not limited to a stabilizer rod assembly having this precise range of adjustment.

Figure 12:
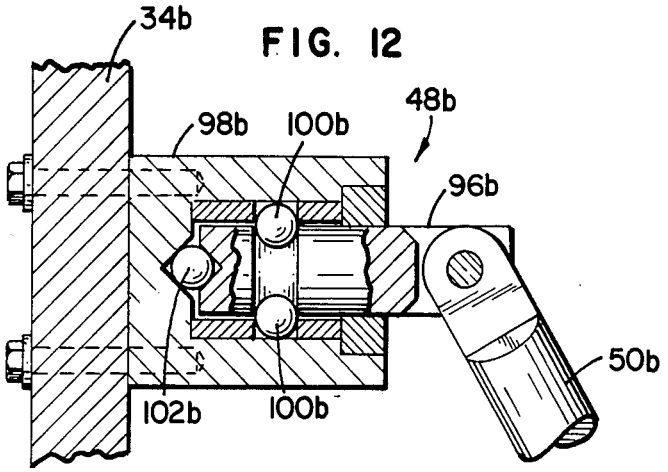
FIG. 12 is a cross-sectional view of an upper pivoting head assembly of the stabilizer shown in FIG. 3, taken generally along line 12—12.

Reference is made to FIG. 12, where the upper pivoting head assembly **48*b* is illustrated. The inner tube 50 is pivotally attached to a universal shaft 96 which freely rotates within a universal housing 98 by virtue of a plurality of circumferential balls 100 and an axial alignment ball 102 engaging the end of the universal shaft 96 opposite from the end which is pivotally connected to the inner tube 50. The universal housing 98 is connected to the main upright 34** using conventional fasteners.

Figure 13:
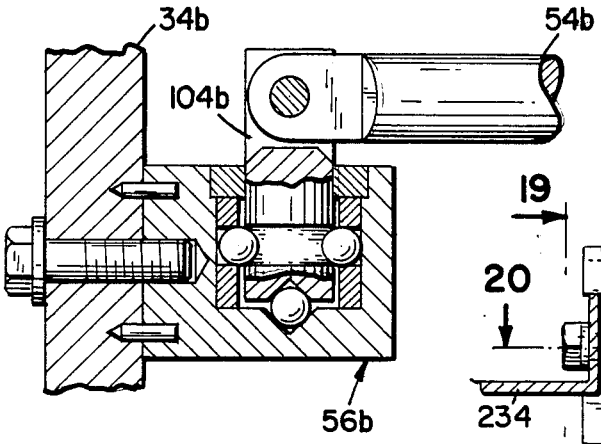
FIG. 13 is a cross-sectional view of a lower pivoting head assembly of the stabilizer shown in FIG. 3, taken generally along line 13—13.

FIG. 13 shows a cross-sectional view of one of the lower pivoting head assemblies 56 or 60. It can readily be seen that the lower pivoting head assemblies 56 and 60 are mechanically virtually identical to the upper pivoting head assemblies 48 except that the universal shafts 104 of the lower assemblies 56 and 60 are substantially parallel to the uprights 34. By contrast, the universal shafts 98 of the upper pivoting head assemblies 48 are substantially perpendicular to the uprights 34. Of course, the lower assemblies 56 and 60 also differ in that they pivotally carry the diagonal adjusting rods 54 and 58 as opposed to the inner tubes 50. It should be noted that the lower pivoting head assemblies 60 are substantially identical to the pivoting head assemblies 56 but for the fact that the assemblies 60 are attached to uprights 36 rather than uprights 34.

The entire adjustment process for the ladder stabilizers 32 can now be described. The set screws 68 and 87 in the stabilizer rod locks 62 and the diagonal rod locks 81 and 82 are loosened to allow the free telescoping movement of the stabilizer rod assemblies 46 and to allow the free movement of the diagonal adjusting rods 54 and 58 relative to the diagonal rod locks 81 and 82. By loosening the stabilizer rod locks 62 the rod assemblies 46 can be individually lengthened or shortened depending on the ground conditions near the base of step ladder 30.

The stabilizer rod assemblies 46 can also be angularly adjusted relative to the step ladder 30 depending on the conditions present at the time of adjustment. For example, if there is a wall near one side of the step ladder 30, it may be necessary to draw the stabilizer rod assembly 46 near the wall closer to the step ladder 30. However, the other stabilizer rod assembly 46 could be maintained in its fully extended position to provide the greatest lateral stability. In addition, the rod assemblies 46 can be transversely adjusted so that they are not contained within an imaginary plane which bisects the angle betwen the front uprights 34 and the rear uprights 36. Once the rod assemblies 46 are adjusted to their proper lengths and are laterally and transversely adjusted to accommodate the environment in which the ladder is being used, the set screws 68 and 87 are tightened to lock the entire assembly 32 relative to the step ladder 30.

Figure 4:
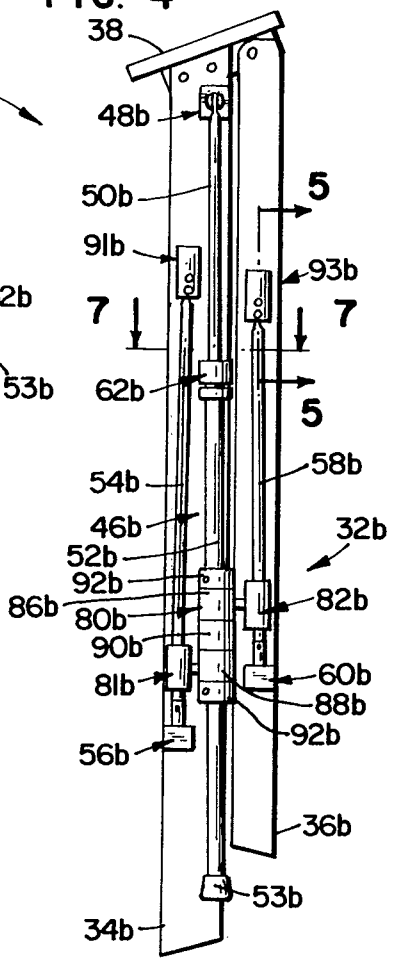
FIG. 4 is a side elevational view of the ladder and stabilizer of FIG. 1 in a collapsed state.
Figure 5:
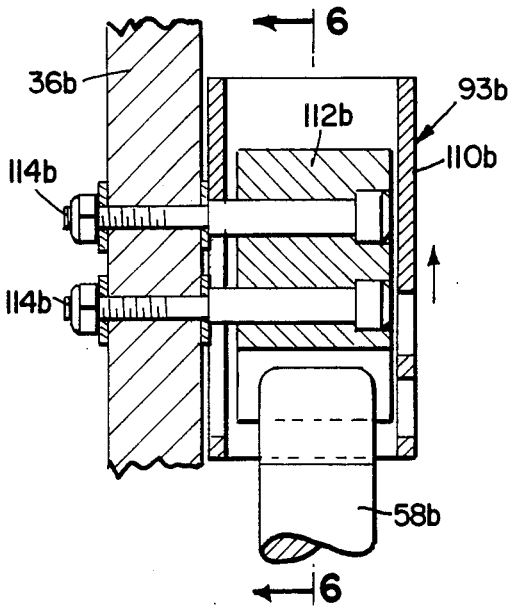
FIG. 5 is a cross-sectional view of a diagonal rod retainer of the ladder stabilizer of FIG. 4, taken generally along line 5—5.
Figure 6:
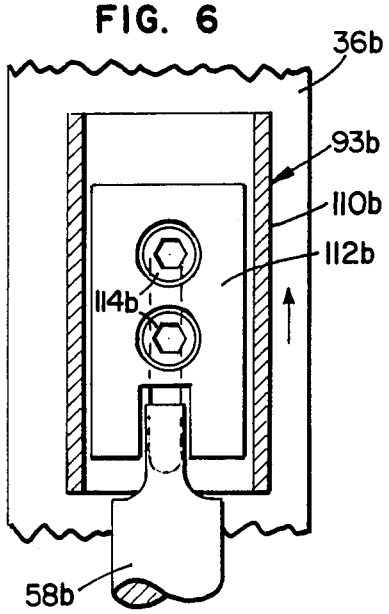
FIG. 6 is a cross-sectional view of the diagonal rod retainer of the ladder stabilizer of FIG. 5, taken generally along line 6—6.

When it is desirable to store or transport the step ladder 30 and ladder stabilizers 32, they can be collapsed as shown in FIG. 4. To accommodate the storage of the step ladder 30, retainer assemblies 91 and 93 are mounted on the uprights 34 and 36, respectively, proximate the platform 38, as shown in FIG. 4. The retainer assemblies 91 and 93 are preferably substantially identical. FIG. 5 shows a cross-sectional view of one of the retainers 93, taken generally along line 5—5 of FIG. 4. The retainer assemblies 93 each include a tube-like sleeve 110 and in alignment element 112 housed within the sleeve 110. The alignment element 112 is connected to the corresponding ladder upright 34 or 36 through the use of a pair of threaded connectors 114. The sleeve 110 is slotted on its back side to allow it to slide relative to the alignment element 112 on the threaded connectors 114.

When storage or transportation of the step ladder 30 is desired, the lock assemblies 62, 81 and 82 area loosened to allow free movement of their associated rods or tubes. The stabilizer rods 46 are extended to their maximum displacement from the step ladder 30. The uprights 34 and 36 are retracted to a closed position by manipulation of the stop braces 40 in a conventional manner. The diagonal rods 54 and 58 are then rotated so as to substantially align with the uprigths 34 and 36 as shown in FIG. 4. Once the ends of the diagonal rods make contact with their corresponding retainer cylinders 91 and 93, the sleeves 110 are lifted to align the ends of the diagonal rods 54 and 58 with the alignment elements 112 housed within the sleeves 110. Once the upper ends or tips of the diagonal rods 54 and 58 have been received by the alignment elements 112, the sleeves 110 can be lowered to fully capture the diagonal rod ends. The final operation is to appropriately rotate the set screws 68 of the stabilizer rod locks 62 so as to prevent any further movement of the inner tubes 50 relative to the corresponding outer tubes 52. This final operation secures all of the components and the collapsed step ladder 30 can be stored or transported without fear of the components releasing from the locked postion. When the step ladder 30 is to be again used, the storage procedure outlined above is reversed. That is, the first step would be to loosen the stabilizer rod locks 62 so as to allow lengthening of the stabilizer rod assemblies 46 and so on.

Figure 14:
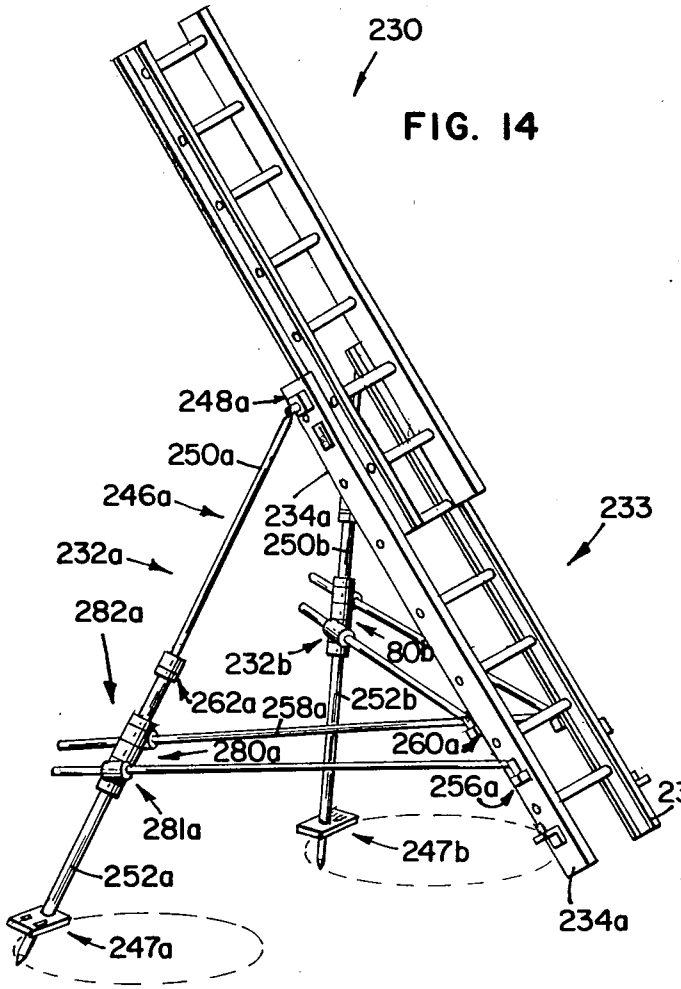
FIG. 14 is a perspective view of an extension ladder provided with a ladder stabilizer of the present invention with the ladder and stabilizer in their extended states.

FIG. 14 shows a second embodiment of the present invention, an extension ladder 250 including a pair of ladder stabilizers 232. As most of the components of the ladder stabilizers 232 are substantially identical to the components of the ladder stabilizers 32 for step ladder 30, the last two digits of fo the reference numbers will be repeated when possible. For example, ladder stabilizers 232 include stabilizer rod assemblies 246 which are substantially identical to assemblies 46 of the step ladder embodiment and are pivotally attached to the uprights 234 toward the apex of the lower extension section 233. The stabilizer rod assemblies 246 include inner tubes 250 and outer tubes 252. The inner tubes 250 are pivotally connected to the upper portion of the lower extension section 233 using upper pivoting head assemblies 248 which are preferably mechanically identical to the upper pivoting assemblies 48 described above. At the uppermost portions of the outer tubes 252 are stabilizer rod locks 262 which are preferably identical to the stabilizer rod locks 62 described above.

Also, the outer tubes 252 preferably carry ring assemblies 280 and at their lowermost points carry spike assemblies 247. The spike assemblies 247 will be further described below.

One significant difference between the ladder stabilizers 232 and the ladder stabilizers 32 is that the diagonal adjusting rods 254 and 258 are substantially longer than the diagonal adjusting rods 54 and 58 of the step ladder embodiment. Also, the diagonal adjusting rods 254 and 258 are connected openly to the main uprights 234 of the lower extension section 233. This is in contrast to the connection scheme employed by the step ladder stabilizers 32 wherein the diagonal rods 54 and 58 are attached to opposing uprights 34 and 36. The diagonal rods 254 and 258 of the extension ladder embodiment shown in FIG. 14 are actually connected to opposite sides of the ladder, i.e., attached to uprights 234*a* and 234*b* which are spanned by the rungs of the ladder.

Adjustment of the ladder stabilizers 232 is very similar to the adjustment of the ladder stabilizers 32. The rod assemblies 246 can be lengthened or shortened by loosening the set screws of the corresponding stabilizer rod locks 262. The upper head assemblies 248 and the lower head assemblies 256 and 260 allow for free movement of the various components of the ladder stabilizer 232 when the set screws of the locks are loosened as described above with reference to the step ladder embodiment. The angles between the rod assemblies 246 and the extension ladder can be varied by simply allowing the diagonal adjusting rods 254 and 258 to freely slide through their corresponding locking cylinders 281 and 282. When the proper angular relationship between the stabilizer rod assemblies 246 and the extension section 233 is established, the set screws of the locking cylinders are again tightened so as to rigidly lock the stabilizer rod assemblies 246 relative to the ladder extension section 233. Of course, the rod assemblies 246 can be laterally and transversely adjusted in a manner similar to the rod assemblies 46.

Figure 21:
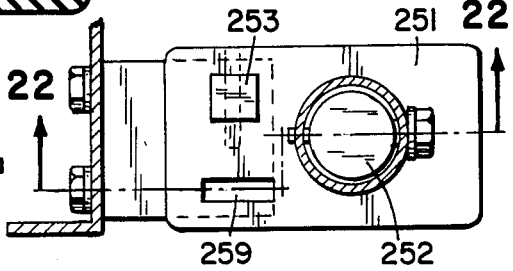
FIG. 21 is a top plan view of a stabilizer support bracket and stabilizer spike assembly of the ladder stabilizer of FIG. 16, viewed generally along line 21—21.
Figure 22:
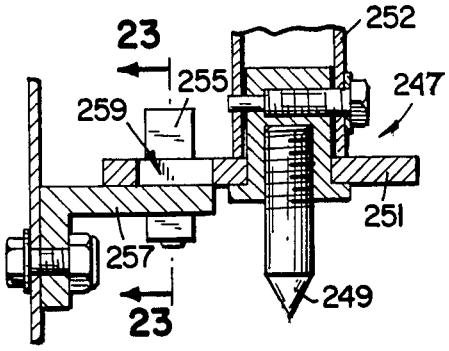
FIG. 22 is a cross-sectional view of the stabilizer support bracket and spike assembly of FIG. 21, taken generally along line 22—22.
Figure 23:
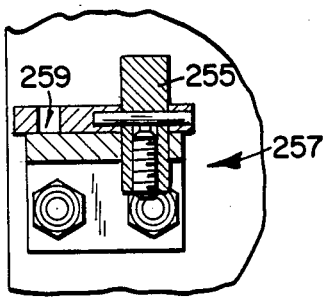
FIG. 23 is a cross-sectional view of the stabilizer support bracket and spike assembly of FIG. 22, taken generally along line 23—23.

As noted above, the lower ends of the outer tubes 252 carry spike assemblies 247, components not found on the rod assemblies 46 of the step ladder embodiment 32. Of course, if the extension ladder were to be used indoors, the spike assemblies 247 would normally be removed and replaced with, for example, rubber cups as described above with reference to the step ladder embodiment. Referring to FIGS. 21, 22 and 23, the spike assemblies 247 each include a spike 249 and a plate 251 which forms a hole 253. The hole 253 is large enough to receive a square peg 255 which extends upward from an L-bracket 257 which is connected to the base of an upright 234 of the lower extension section 233. The plate 251 also forms a slot 259 which receives the tip of one of the diagonal rods 254 when the entire ladder is collapsed for storage or transportation.

Figure 18:
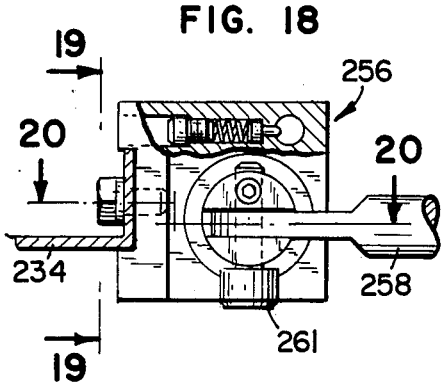
FIG. 18 is a top plan partially broken view of a lower pivoting head assembly of the ladder and stabilizer shown in FIG. 17, viewed generally along line 18—18.
Figure 20:
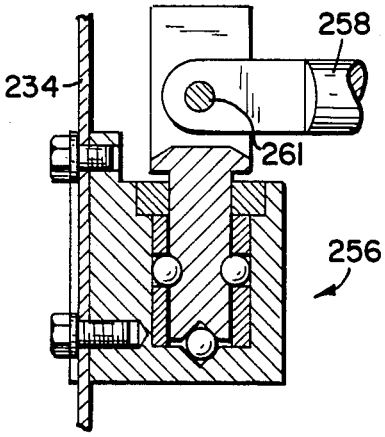
FIG. 20 is a cross-sectional view of the lower pivoting head assembly of FIG. 18, taken generally along line 20—20.
Figure 19:
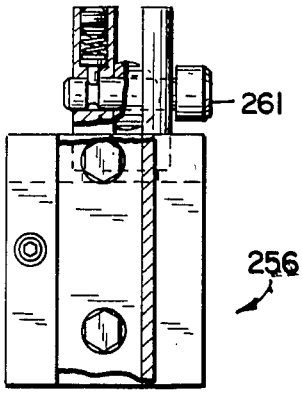
FIG. 19 is an elevational partially broken view of the lower pivoting head assembly of FIG. 18, as viewed generally along line 19—19.
Figure 15:
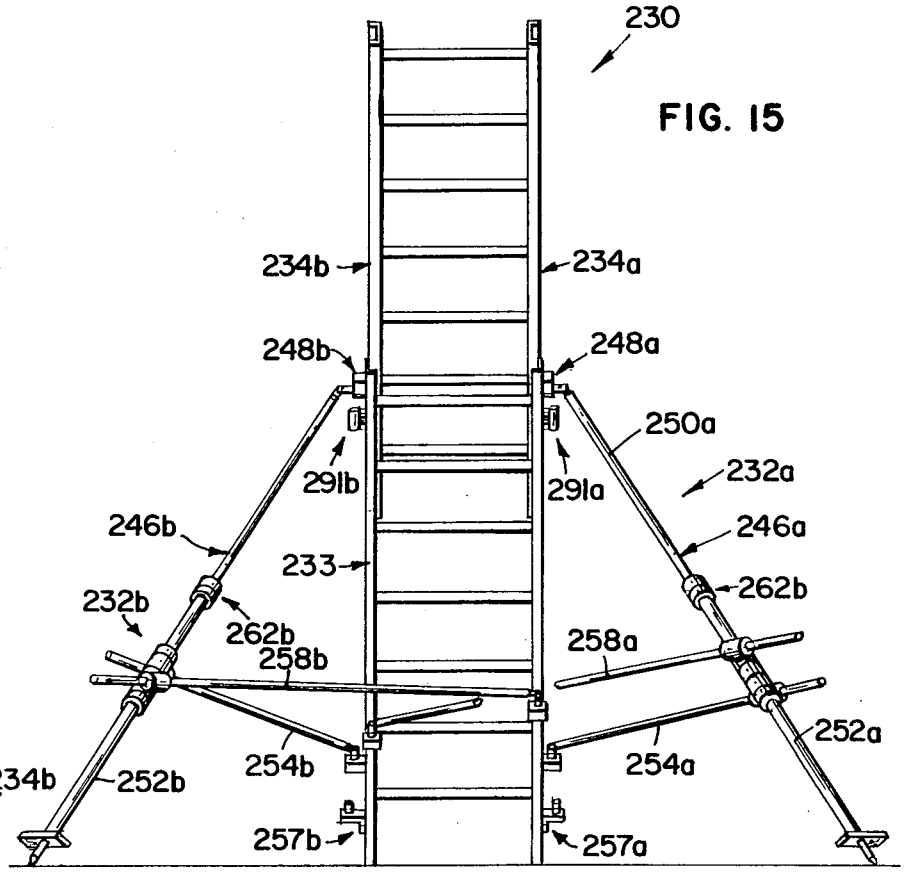
FIG. 15 is a rear elevational view of the ladder and stabilizer of FIG. 14.

Storage of the extension ladder 230, including the extension ladder stabilizers 232, can now be described. First, all of the locks are released by appropriately turning their respective set screws. Referring to FIGS. 18 and 19, the longest diagonal rods, the diagonal rods 258, are then disconnected from their universal head shafts by removing pins 261 which pivotally connect the universal shafts with the long diagonal rods 258. One of the pins 261 which is removed to allow the disconnection of the associated long diagonal rod 258 from its corresponding universal shaft is shown in FIGS. 18, 19 and 20. Once the pin 261 has been removed, the flat ends of the long diagonal rods 258 are allowed to hang vertically toward the base of the extension ladder 230. The long diagonal rods 258 are then retracted from their extended positions, drawing them next to the ladder uprights 234. Similarly, the shorter diagonal rods 254 are aligned with the uprights 234 so that the flat ends of the diagonal rods 254 are adjacent the retaining sleeves 291. These flat ends are retained by the retaining sleeves 291 in a manner similar to the operation of the sleeves 91 and 92 described above with reference to the step ladder embodiment.

The stabilizer rod assemblies 246 are then manipulated so as to bring the spike assemblies 247 in contact with the corresponding L-brackets 257. The square holes 253 of the plates 251 are placed over the peg 255 which protrude from the L-bracket 257. The flattened ends of the longer diagonal rods 258 are then placed in the rectangular slots 259 in the L-brackets 257.

Figure 16:
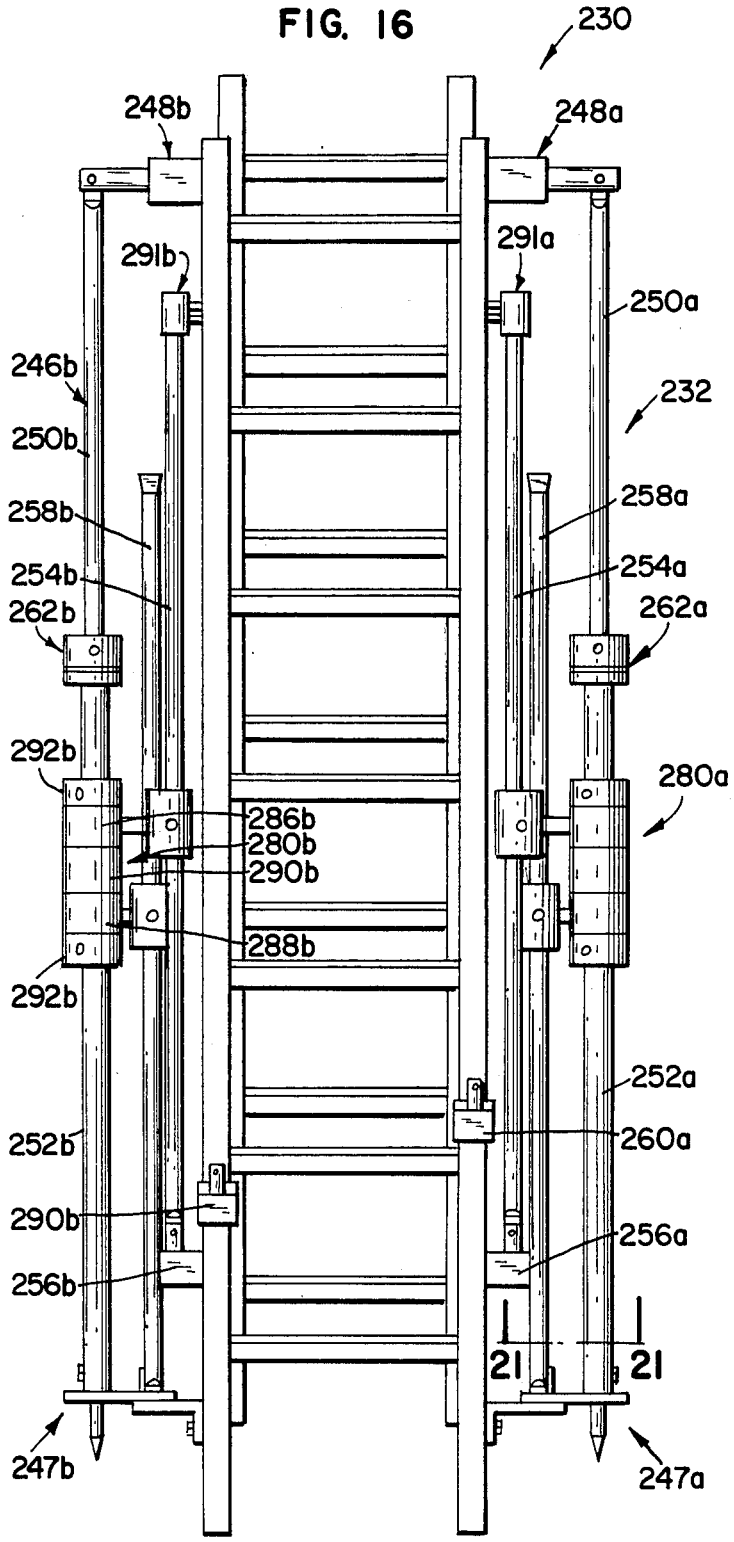
FIG. 16 is a rear elevational view of the ladder and stabilizer of FIG. 14 in their collapsed states.
Figure 17:
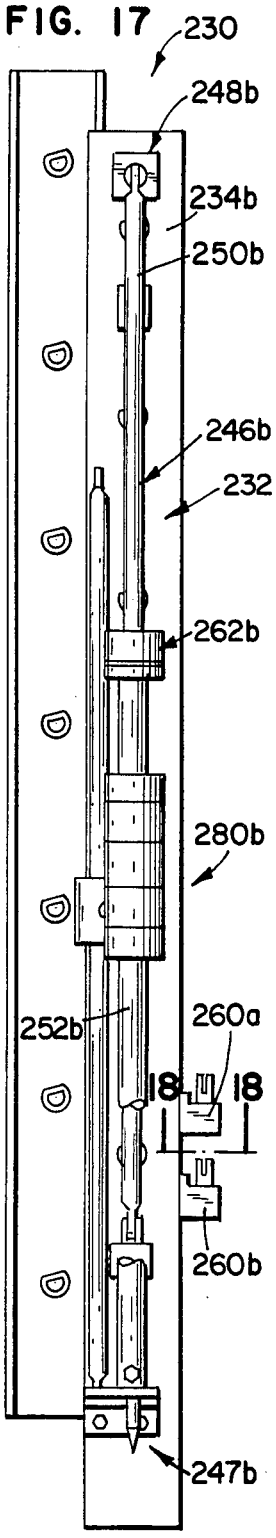
FIG. 17 is a side elevational view of the collapsed ladder and stabilizer of FIG. 16.

Following the appropriate alignment of all of the components adjacent the uprights 234, the set screws of the locks are rotated to lock all of the components in place. The collapsed extension ladder is stored by positioning the pivoting head assemblies 260 attached to the uprights 234 outward or upward so that they are not damaged. FIGS. 16 and 17 show the extension ladder 230 in this collapsed state.

When the extension ladder 230 is to be used, the storage sequence described above is reversed: the locks are released, and so on.

It should be noted that the spikes 249 are most appropriately used when the extension ladder 230 is positioned on an earth surface. Adaptors could be attached to the spike 249 using a set screw or the like, wherein the adaptors would carry a rubber cup (e.g., rubber cups 53 used on the step ladder embodiment 32) or the like which would be more appropriate for indoor use.

It should be emphasized that the present invention is not limited to any particular materials or combination of materials, and modifications of the invention will be apparent to those skilled in the art in light of the foregoing description. This description is intended to provide specific examples of individual embodiments which clearly disclose the present invention. Accordingly, the invention is not limited to these embodiments or to the use of elements having the specific configurations and shapes as presented herein. All alternative modifications and variations of the present invention which fall within the spirit and broad scope of the appended claims are included.

We claim:

1. A ladder stabilizer for a ladder having first and second uprights suitable for resting on a ground surface, comprising:

(a) a stabilizer member having a top portion and a bottom portion, wherein the bottom portion is suitable for engaging the ground surface;

(b) means for pivotally connecting the top portion of the stabilizer member to the ladder;

(c) first adjusting means for operatively connecting the stabilizer member to the first upright; and (d) second adjusting means for operatively connecting the stabilizer member to the second upright, wherein the stabilizer member can be laterally adjusted to vary the distance between the bottom portion of the stabilizer member and the ladder, wherein:

(i) the first adjusting means comprises a first adjusting element pivotally connected to the first upright and means for slidably connecting the first adjusting element to the stabilizer member;

(ii) the second adjusting means comprises a second adjusting element pivotally connected to the second upright and means for slidably connecting the second adjusting element to the stabilizer member;

(iii) the stabilizer member comprises a central portion between its top and bottom portions, and wherein the first and second adjusting elements are slidably connected to the stabilizer member's central portion;

(iv) the means for slidably connecting the adjusting elements to the stabilizer member each comprise an adjusting element lock assembly operatively connected to the stabilizer member and the respective adjusting element, wherein when the adjusting element lock assemblies are released the stabilizer member can be laterally adjusted, and when the adjusting element lock assemblies are activated the stabilizer member is laterally fixed; and (v) each adjusting element lock assembly comprises:

(A) a lock housing operatively connected to the stabilizer member;

(B) stationary means for gripping the associated adjusting element;

(C) movable means for gripping the associated adjusting element, wherein the gripping elements are operatively connected to the associated lock housing and are configured to receive the associated adjusting element; and (D) means for urging the movable gripping means toward the stationary gripping means, wherein when the urging means are activated the gripping means engage their respective adjusting elements, thereby laterally fixing the stabilizer member, and wherein when the urging means are released the adjusting elements can freely slide through their associated lock housings and the stabilizer member can be laterally adjusted.

2. The ladder stabilizer according to claim 1, wherein the gripping means are hardened screws contained within the associated lock housing and axially aligned with the associated adjusting element.

3. The ladder stabilizer according to claim 2, wherein each urging means comprises a set screw threadedly connected to the associated lock housing and arranged substantially perpendicular to the associated movable gripping means.

4. A ladder stabilizer for a ladder having first and second uprights suitable for resting on a ground surface, comprising:

(a) a stabilizer member having a top portion and a bottom portion, wherein the bottom portion is suitable for engaging the ground surface;

(b) means for pivotally connecting the top portion of the stabilizer member to the ladder;

(c) first adjusting means for operatively connecting the stabilizer member to the first upright; and (d) second adjusting means for operatively connecting the stabilizer member to the second upright, wherein the stabilizer member can be laterally adjusted to vary the distance between the bottom portion of the stabilizer member and the ladder, wherein:

(i) the stabilizer member comprises first and second telescoping stabilizer submembers and a stabilizer lock assembly operatively connected to the telescoping submembers, wherein when the stabilizer lock assembly is released the submembers can slide relative to one another and the length of the stabilizer member can be varied, and when the stabilizer lock assembly is activated the length of the stabilizer member is fixed;

(ii) the first stabilizer submember slides within the second stabilizer submember, and wherein the stabilizer lock assembly comprises:

(A) a stabilizer lock housing operatively connected to the second stabilizer submember;

(B) stationary means for gripping the first submember;

(C) movable means for gripping the first submember, wherein the gripping means are operatively connected to the lock housing and are configured to receive the first submember; and (D) means for urging the movable gripping means toward the stationary gripping means, wherein the first submember can be gripped by the submember gripping means and fixed relative to the second submember upon activation of the urging means, and wherein the gripping means are hardened screws contained within the lock housing axially aligned with the stabilizer submembers.

5. The ladder stabilizer according to claim 4, wherein the urging means comprises a set screw threadedly engaged with the lock housing and arranged substantially perpendicular to the movable gripping means.

6. A ladder stabilizer for a ladder having first and second uprights suitable for resting on a ground surface, comprising:

(a) a stabilizer member comprising first and second telescoping submembers, wherein the first submember slides within the second submember, and a stabilizer lock assembly connected to the second submember and configured to slidably receive the first submember;

(b) means for pivotally connecting the first submember to the ladder;

(c) first adjusting means for operatively connecting the central portion of the stabilizer member to the first upright comprising a first adjusting rod and a first adjusting rod lock assembly operatively connected to the second stabilizer submember configured to slidably receive the first adjusting rod; and (d) second adjusting means for operatively connecting the central portion of the stabilizer member to the second upright comprising a second adjusting rod and a second adjusting rod lock assembly operatively connected to the second stabilizer submember configured to slidably receive the second adjusting rod, wherein each of the lock assemblies comprises:

(i) a lock housing;

(ii) a pair of stationary hardened screws;

(iii) a movable hardened screw; and (iv) a set screw, wherein the hardened screws are contained within the associated housing and are axially aligned with an opening formed by the housing suitable for slidably receiving the associated submember or adjusting rod, and wherein the set screw is threadedly engaged with the lock housing and arranged substantially perpendicular to the associated movable hardened screw, wherein when the set screws are tightened the associated movable hardened screws are caused to move toward their associated stationary hardened screws to thereby cause the hardened screws to grip their associated submember or adjusting rod thereby locking the stabilizer submembers together and laterally fixing the stabilizer member, and when the set screws are loosened the hardened screws release their associated submember or adjusting rod thereby allowing the stabilizer submembers to slide relative to one another and allowing the lateral adjustment of the stabilizer member.

7. The ladder stabilizer according to claim 6, wherein the means for pivotally connecting the first submember to the ladder comprises a universal joint and wherein the adjusting rod lock assemblies are pivotally connected to the second stabilizer submember, wherein the stabilizer member can be adjusted laterally and transversely when the adjusting rod lock assemblies are released.

8. The ladder stabilizer according to claim 7, wherein the ladder is a step ladder, the first upright is a main upright of the step ladder and the second upright is a back upright of the step ladder pivotally opposing the main upright, and wherein the first submember is connected to the apex of the step ladder.

9. The ladder stabilizer according to claim 8, wherein the stabilizer member and the adjusting means can be substantially collapsed against and into alignment with the pivotally opposing uprights of the step ladder.

10. The ladder stabilizer according to claim 7, wherein the ladder is an extension ladder and the uprights are associated with the lower section of the extension ladder.

11. The ladder stabilizer according to claim 10, wherein the stabilizer member and the adjusting means can be substantially collapsed against and into alignment with the uprights of the lower section of the extension ladder.

12. A ladder stabilizer for a ladder having a plurality of uprights suitable for resting on a ground surface, comprising:

(a) a pair of stabilizer members each comprising first and second telescoping submembers, wherein the first submember slides within the associated second submember, and a stabilizer lock assembly connected to the associated second submember and configured to slidably receive the associated first submember;

(b) means for pivotally connecting the first submembers to opposite sides of the ladder;

(c) first adjusting means for operatively connecting the central portion of each stabilizer member to one of the ladder uprights, each of the first adjusting means comprising a first adjusting rod and a first adjusting rod lock assembly operatively connected to the associated second stabilizer submember configured to slidably receive the associated first adjusting rod; and (d) second adjusting means for operatively connecting the central portion of each stabilizer member to another of the uprights, each of the second adjusting means comprising a second adjusting rod and a second adjusting rod lock assembly operatively connected to the associated second stabilizer submember configured to slidably receive the associated second adjusting rod, wherein each of the lock assemblies comprises:

(i) a lock housing;

(ii) a pair of stationary hardened screws;

(iii) a movable hardened screw; and (iv) a set screw, wherein the hardened screws are contained within their associated housing and are axially aligned with an opening formed by the housing suitable for slidably receiving the associated submember or adjusting rod, and wherein the set screw is threadedly engaged with the lock housing and arranged substantially perpendicular to the associated movable hardened screw, wherein the set screws are tightened the associated movable hardened screws are caused to move toward their associated stationary hardened screws to thereby cause the hardened screws to grip their associated submember or adjusting rod thereby locking the associated stabilizer submembers together and laterally fixing the stabilizer members, and when the set screws are loosened the hardened screws release their associated submember or adjusting rod thereby allowing the stabilizer submembers to slide relative to one another and allowing the lateral adjustment of the stabilizer members.

13. The ladder stabilizer according to claim 12, wherein the ladder is a step ladder, the first upright is a main upright of the step ladder and the second upright is a back upright of the step ladder pivotally opposing the main upright, and wherein the first submember is connected to the apex of the step ladder.

14. The ladder stabilizer according to claim 13, wherein the stabilizer members and the adjusting means can be substantially collapsed against and into alignment with the associated pivotally opposing uprights of the step ladder.

15. The ladder stabilizer according to claim 12, wherein the ladder is an extension ladder and the uprights are associated with the lower section of the extension ladder.

16. The ladder stabilizer according to claim 15, wherein the stabilizer members and the adjusting means can be substantially collapsed against and into alignment with the uprights of the lower section of the extension ladder.

* * * * *